US008632707B2

(12) United States Patent
Breuer et al.

(10) Patent No.: US 8,632,707 B2
(45) Date of Patent: Jan. 21, 2014

(54) FABRIC FOR NON-WOVEN WEB FORMING PROCESS AND METHOD OF USING SAME

(75) Inventors: Hans Peter Breuer, Zell u.A (DE); Harald Reiterer, Grafenbach (AT)

(73) Assignee: Huyck Licensco Inc., Raleigh, NC (US)

( * ) Notice: Subject to any disclaimer, the term of this patent is extended or adjusted under 35 U.S.C. 154(b) by 201 days.

(21) Appl. No.: 13/235,873

(22) Filed: Sep. 19, 2011

(65) Prior Publication Data

US 2012/0074609 A1 Mar. 29, 2012

Related U.S. Application Data

(60) Provisional application No. 61/387,109, filed on Sep. 28, 2010.

(51) Int. Cl.
*D03D 23/00* (2006.01)
*D04H 3/02* (2006.01)

(52) U.S. Cl.
USPC ..... 264/103; 264/211.12

(58) Field of Classification Search
USPC ..... 264/103, 211.12; 139/383 R, 420 A, 139/383 A
See application file for complete search history.

(56) References Cited

U.S. PATENT DOCUMENTS 5,421,374 A * 6/1995 Wright ..... 139/383 A
5,713,398 A 2/1998 Josef
2003/0164199 A1 9/2003 Levine et al.
2003/0208886 A1 11/2003 Monnerie et al.
2011/0036527 A1* 2/2011 Ward ..... 162/289

FOREIGN PATENT DOCUMENTS

WO WO 03/031711 A1 4/2003
WO WO 2009/030033 A1 3/2009

OTHER PUBLICATIONS

International Search Report and Written Opinion for PCT/US2011/052451 mailed Mar. 9, 2012.
International Preliminary Report on Patentability PCT/US2011/052451 mailed Jan. 30, 2013.

* cited by examiner

*Primary Examiner* — Leo B Tentoni
(74) *Attorney, Agent, or Firm* — Myers Bigel Sibley & Sajovec, P.A.

(57) ABSTRACT

A method of manufacturing a non-woven web includes the step of collecting stretched filaments that form the non-woven web on a fabric in an apparatus for the formation of non-woven webs. The fabric comprises machine direction (MD) yarns and cross-machine direction (CMD) yarns, wherein the MD and CMD yarns are interwoven in a repeating pattern in which at least some of the CMD yarns are interwoven with the MD yarns in pairs that follow the same weaving sequence. Such a fabric can provide potential advantages such as reduced air leakage, reduced air disturbances, and improved web hold-down effect.

16 Claims, 3 Drawing Sheets

FABRIC FOR NON-WOVEN WEB FORMING PROCESS AND METHOD OF USING SAME

RELATED APPLICATION

This application claims priority from U.S. Provisional Patent Application No. 61/387,109, filed Sep. 28, 2011, the disclosure of which is hereby incorporated herein by reference in its entirety.

BACKGROUND OF THE INVENTION

Non-woven spun-bond webs formed from filaments or fibers are typically made from a thermoplastic resin on an apparatus such as that disclosed in U.S. Pat. No. 5,814,349, the disclosure of which is incorporated herein by reference. Such apparatus typically includes a spinneret for producing a curtain of strands and a process-air blower for blowing process air onto the curtain of strands for cooling same to form thermoplastic filaments. The thermoplastic filaments are then typically, aerodynamically entrained by the process air for aerodynamic stretching of the thermoplastic filaments which are then, after passing through a diffuser, deposited upon a continuously circulating sieve belt or fabric for collecting the interentangled filaments and forming a web thereon. The web, so formed, is then subject to further processing. An exemplary apparatus of this type, particularly for high-speed spun-bond web production, is currently available from Reifenhauser GmbH Co. Maschinenfabrik, Troisdorf, Germany and sold under the name Reicofil®. Other exemplary forming machines are available from Oerlikon Neumag, Neumunster, Germany.

Such equipment endeavors to operate at higher and higher speeds. Most of the high-speed technology involves less than 2 denier filament base webs, with the highest speed spinning relative to less than 1 denier, termed micro denier webs. The high-speed spinning involves high velocity, small diameter fibers that will naturally exhibit bounce at impact, due to the high-speed, and bleed through the sieve belt or fabric, due to their small size relative to fabric open area. Also, in some machines fabrics need to allow for the removal of excessive quantities of air in "sealed" type arrangements as disclosed in the aforesaid patent. In other machines, there is no sealed chamber, but the material drains onto a web. In such a situation, accordingly it is desirable to have a fabric with high permeability, low bleed, and sufficient topography to avoid uncontrollable fiber "splashing" during deposition. Also, new high-speed systems place the diffuser close to the fabric which increases both the magnitude and quantity of high velocity vertical impingement of fiber onto the fabric.

Current fabrics or belts used in high-speed spun-bond manufacturing lines are a compromise between good hold down and excessive bleed through. For example, while a fabric may provide for good hold down of the web, it may do so at the expense of fiber penetration and bleed through into the fabric or belt. Alternatively, while a fabric may limit bleed through of deposited filaments, it does so at the expense of web hold down. One exemplary fabric is discussed in U.S. Pat. No. 7,578,317, the disclosure of which is hereby incorporated herein in its entirety. Another exemplary fabric is discussed in International Patent Publication WO 09/030033, the disclosure of which is hereby incorporated herein by reference. It may be desirable to provide other fabrics for spun-bond manufacturing lines, particularly those that operate at high speeds.

SUMMARY OF THE INVENTION

As a first aspect, embodiments of the present invention are directed to a method of manufacturing a non-woven web. The method comprises the step of collecting stretched filaments that form the non-woven web on a fabric in an apparatus for the formation of non-woven webs. The fabric comprises machine direction (MD) yarns and cross-machine direction (CMD) yarns, wherein the MD and CMD yarns are interwoven in a repeating pattern in which at least some of the CMD yarns are interwoven with the MD yarns in pairs that follow the same weaving sequence. Such a fabric can provide potential advantages such as reduced air leakage, reduced air disturbances, and improved web hold-down effect.

As a second aspect, embodiments of the present invention are directed to a method of manufacturing a non-woven web comprising the step of collecting stretched filaments that form the non-woven web on a fabric in an apparatus for the formation of non-woven webs, wherein the fabric comprises MD yarns, single bottom CMD yarns, and top CMD yarns, wherein the MD and CMD yarns are interwoven in a repeating pattern in which at least some of the top CMD yarns are interwoven with the MD yarns in pairs that follow the same weaving sequence.

As a third aspect, embodiments of the present invention are directed to a method of manufacturing a non-woven web comprising the step of collecting stretched filaments that form the non-woven web on a fabric in an apparatus for the formation of non-woven spun-bond webs, wherein the fabric comprises MD yarns and CMD yarns, wherein the MD and CMD yarns are interwoven in a repeating pattern in which all of the CMD yarns are interwoven with the MD yarns in pairs that follow the same weaving sequence, and wherein the CMD yarns are round in cross-section.

DETAILED DESCRIPTION OF EMBODIMENTS OF THE INVENTION

Figure 1:
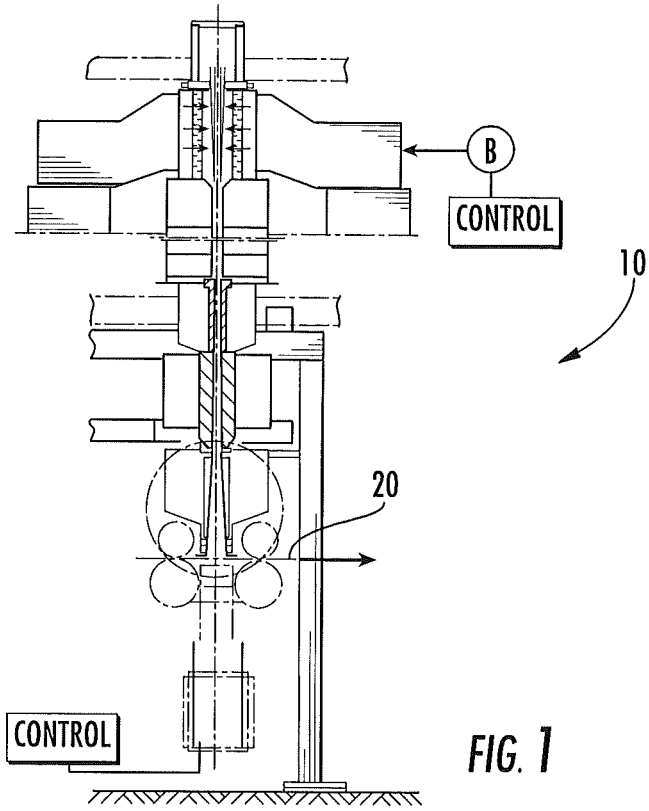
FIGS. 1 and 2 are schematic diagrams of a spun-bond manufacturing apparatus.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Figure 2:
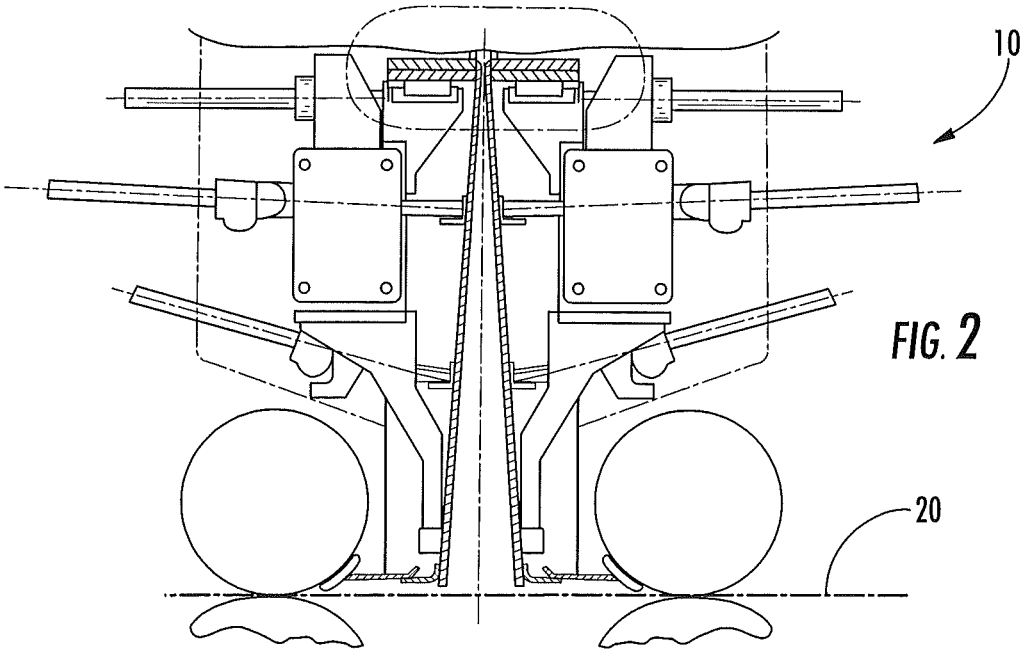

Turning now more particularly to the drawings, FIGS. 1 and 2 are generally diagrammatic drawings of an apparatus 10 for high-speed spun-bond production for a non-woven web of material. For purposes of this discussion, the term "web" is being used to designate the non-woven fabric which is being produced by the high-speed spun-bond apparatus. This is to be distinguished from the sieve belt or fabric or continuous endless belt or seamed belt on which the web is formed as referenced in the aforesaid U.S. Pat. No. 5,814,349. The fabric as disclosed herein equates to the aforesaid belt. In this regard, FIGS. 1 and 2 are shown as merely representative of a spun-bond apparatus and should not be considered exclusive to the present invention.

Figure 3:
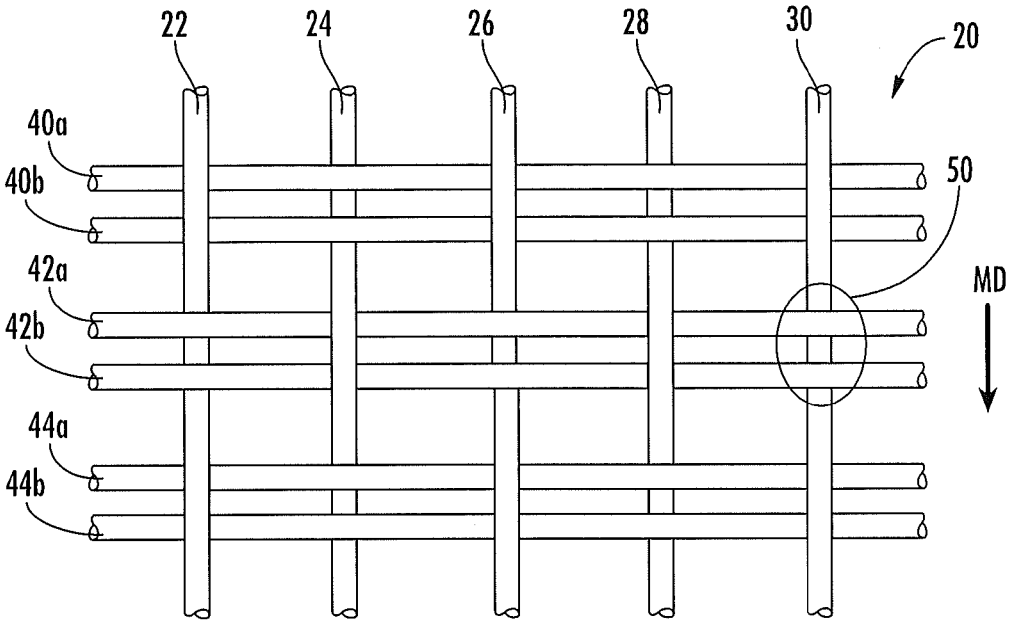
FIG. 3 is an enlarged view of an exemplary weave pattern for a fabric employed in the apparatus of FIGS. 1 and 2.

Turning now to FIG. 3, a fabric 20 that can be employed in the apparatus of FIGS. 1 and 2 is illustrated therein. The fabric 20 includes MD yarns 22, 24, 26, 28, 30 and CMD yarns 40*a*, 40*b*, 42*a*, 42*b* and 44*a*, 44*b* that are interwoven with the MD yarns. The MD yarns and CMD yarns are woven in a plain weave pattern (i.e., an "over 1/under 1" repeating pattern), with the exception that the CMD yarns are woven with the MD yarns in pairs, such that CMD yarns of the same pair follow the same weaving sequence. For example, CMD yarns 40*a*, 40*b* both pass under MD yarn 22, over MD yarn 24, under MD yarn 26, over MD yarn 28, and under MD yarn 30. The same pairing occurs for the other CMD yarns as they interweave with the MD yarns.

The yarns comprising the fabric 20 typically comprise monofilaments, usually round monofilaments. Some of the yarns in either the MD and/or CMD may be static dissipative yarns, typically with a copper sulfide or carbon coating. In some embodiments the yarns of a yarn pair may be different yarns; for example, one yarn of a pair may have a different diameter than the other yarn of the pair or may be formed of a different material.

Adjacent round CMD yarns can create a distinct shape which guides air drawn through the fabric 20 in an advantageous manner for the web forming process. Potential advantages may include reduced air leakage, reduced air disturbances, and improved web hold-down effect. Also, adjacent round CMD yarns can create convex contact areas with the web whereby the contact surface is interrupted (as, for example, area 50 in FIG. 3). This may facilitate removal of dirt and molten drops of polymer left over from the web forming process.

Figure 4:
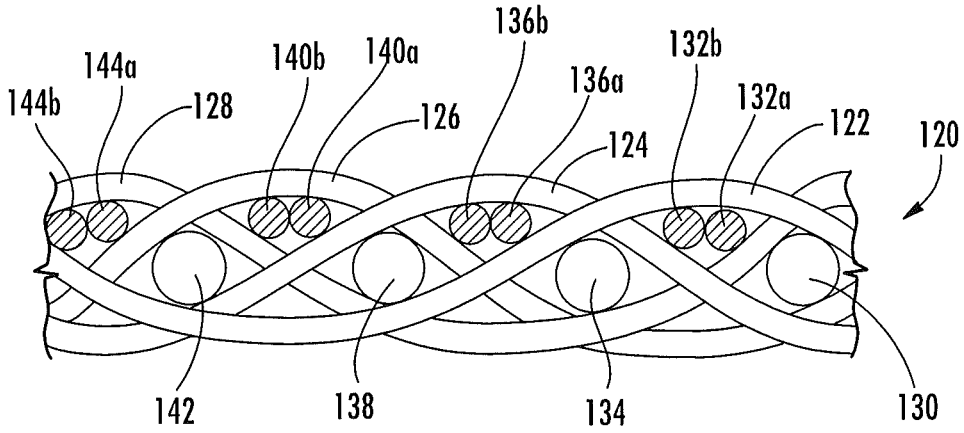
FIG. 4 is an enlarged cross-section of an exemplary weave pattern for an alternative fabric employed in the apparatus of FIGS. 1 and 2.

The illustrated weave pattern of the fabric 20 may vary. An alternative exemplary weave pattern is shown in FIG. 4, which illustrates a fabric 120. The fabric 120 includes MD yarns 122, 124, 126, 128, single bottom CMD yarns 130, 134, 138, 142, and paired top CMD yarns 132*a*, 132*b*, 136*a*, 136*b*, 140*a*, 140*b*, 144*a*, 144*b*. As can be seen in FIG. 4, the MD yarns are interwoven with the CMD yarns such that each MD yarn passes over two adjacent single bottom CMD yarns and one pair of paired top CMD yarns, then under two adjacent single bottom CMD yarns and three pairs of paired top CMD yarns. For example, MD yarn 122 passes over adjacent single bottom CMD yarns 130 and 134 as well as paired top CMD yarns 132*a*, 132*b*, then passes under adjacent single bottom CMD yarns 138, 142 and paired top CMD yarns 136*a*, 136*b*, 140*a*, 140*b*, 144*a*, 144*b*. The result is a fabric in which single bottom CMD yarns alternate with paired top CMD yarns within the weave. As illustrated in FIG. 4, in some embodiments the single CMD yarns may be of a different size and/or material type than the paired CMD yarns.

Figure 5:
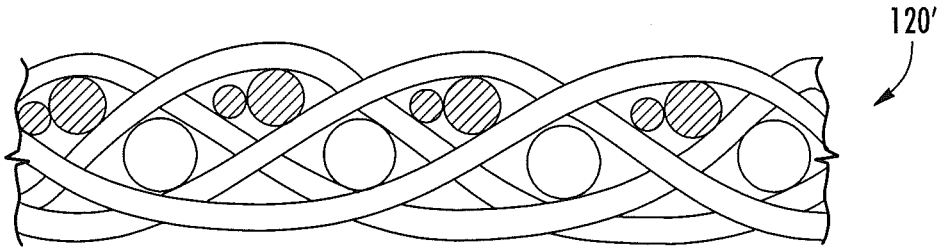
FIG. 5 is an enlarged cross-section of an exemplary weave pattern for another alternative fabric employed in the apparatus of FIGS. 1 and 2.
Figure 6:
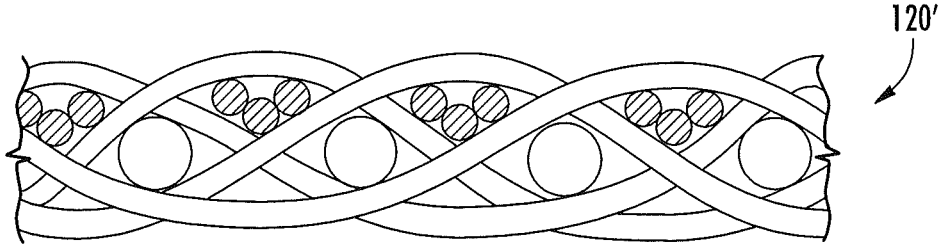
FIG. 6 is an enlarged cross-section of an exemplary weave pattern for still another alternative fabric employed in the apparatus of FIGS. 1 and 2.

Modifications of the fabric 120 are shown in FIGS. 5 and 6. FIG. 5 illustrates a fabric 120' which is identical to the fabric 120 with the exception that the top CMD yarns 132*a*', 132*b*'-144*a*'-144*b*' within a pair are of different sizes. As mentioned above, the yarns of the pair may also be formed of different materials. FIG. 6 illustrates a fabric 120" that is identical to the fabric 120 with the exception that the paired top CMD yarns are replaced with a trio of top CMD yarns (e.g., CMD yarns 132*a*", 132*b*"). Thus, it can be seen that in some embodiments, the paired yarns may be replaced with three or more yarns that weave in the same sequence.

Those of skill in this art will appreciate that although a spun-bond apparatus is shown herein, the fabrics 20, 120, 120', 120" may be equally suited for the formation of a non-woven web via another manufacturing technique, such as an air-laid technique.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A method of manufacturing a non-woven web, comprising the step of:

collecting stretched filaments that form the non-woven web on a fabric in an apparatus for the formation of non-woven webs, wherein the fabric comprises machine direction (MD) yarns and cross-machine direction (CMD) yarns, and wherein the MD and CMD yarns are interwoven in a repeating pattern in which at least some of the CMD yarns are interwoven with the MD yarns in pairs that follow the same weaving sequence.

2. The method defined in claim 1, wherein all of the CMD yarns are interwoven with the MD yarns in pairs.

3. The method defined in claim 1, wherein only some of the CMD yarns are interwoven in pairs.

4. The method defined in claim 1, wherein the pairs of CMD yarns are part of a trio of CMD yarns.

5. The method defined in claim 1, wherein the CMD yarns are round in cross-section.

6. The method defined in claim 1, wherein at least some of the CMD yarns are static dissipative yarns.

7. The method defined in claim 1, wherein CMD yarns are monofilaments.

8. The method defined in claim 1, wherein at least one of the CMD yarn pairs comprises CMD yarns of different diameters.

9. The method defined in claim 1, wherein the apparatus is a spun-bond apparatus.

10. A method of manufacturing a non-woven web, comprising the step of:

collecting stretched filaments that form the non-woven web on a fabric in an apparatus for the formation of non-woven webs, wherein the fabric comprises machine direction (MD) yarns, single bottom cross-machine direction (CMD) yarns, and top CMD yarns, wherein the MD and CMD yarns are interwoven in a repeating pattern in which at least some of the top CMD yarns are interwoven with the MD yarns in pairs that follow the same weaving sequence.

11. The method defined in claim 10, wherein the top CMD yarns are round in cross-section.

12. The method defined in claim 10, wherein at least some of the top CMD yarns are static dissipative yarns.

13. The method defined in claim 10, wherein top CMD yarns are monofilaments.

14. The method defined in claim 10, wherein at least one of the top CMD yarn pairs comprises CMD yarns of different diameters.

15. The method defined in claim 10, wherein the apparatus is a spun-bond apparatus.

16. A method of manufacturing a non-woven web, comprising the step of:

collecting stretched filaments that form the non-woven web on a fabric in an apparatus for the formation of non-woven spun-bond webs, wherein the fabric comprises machine direction (MD) yarns and cross-machine direction (CMD) yarns, wherein the MD and CMD yarns are interwoven in a repeating pattern in which all of the CMD yarns are interwoven with the MD yarns in pairs that follow the same weaving sequence, and wherein the CMD yarns are round in cross-section.

* * * * *